US007086450B2

(12) United States Patent
Hiraki et al.

(10) Patent No.: US 7,086,450 B2
(45) Date of Patent: Aug. 8, 2006

(54) CONTINUOUS CASTING METHOD, CONTINUOUS CASTING APPARATUS AND CONTINUOUSLY CAST STEEL SLAB

(75) Inventors: Sei Hiraki, Kashima (JP); Akihiro Yamanaka, Kashima (JP); Toshihiko Murakami, Kashima (JP); Seiji Kumakura, Kashima (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 10/404,087

(22) Filed: Apr. 2, 2003

(65) Prior Publication Data

US 2003/0213578 A1 Nov. 20, 2003

(30) Foreign Application Priority Data

Apr. 8, 2002 (JP) ..... 2002-105604

(51) Int. Cl.
*B22D 11/00* (2006.01)
*B22D 11/12* (2006.01)

(52) U.S. Cl. ..... 164/476; 164/417

(58) Field of Classification Search ..... 164/476, 164/417

See application file for complete search history.

(56) References Cited

U.S. PATENT DOCUMENTS

| | | | |
|---|---|---|---|
| 3,491,823 A | 1/1970 | Tarmann et al. | |
| 3,565,160 A | 2/1971 | Hermann et al. | |
| 3,650,314 A | 3/1972 | Tarmann et al. | |
| 5,348,074 A | 9/1994 | Streubel | |

FOREIGN PATENT DOCUMENTS

| | | | |
|---|---|---|---|
| JP | 61-9954 | * | 1/1986 |
| JP | 61-042460 | | 2/1986 |
| JP | 61-132247 | | 6/1986 |
| JP | 62-028056 | | 2/1987 |
| JP | 07-132355 | | 5/1995 |
| JP | 09-057410 | | 3/1997 |
| JP | 10-52743 | * | 2/1998 |
| JP | 2001-18041 | * | 1/2001 |
| JP | 2001-18042 | * | 1/2001 |
| JP | 2001-162353 | * | 6/2001 |

* cited by examiner

*Primary Examiner*—Kuang Y. Lin
(74) *Attorney, Agent, or Firm*—Clark & Brody

(57) ABSTRACT

A continuous casting method is demonstrated, in which a slab including a liquid core 11 is bulged and then reduced in its thickness with a reduction roll pair 7, in which case, the uppermost surface of the lower roll 7*b* in the reduction roll pair 7 is located at a higher level than the lower pass line 9 of the slab. With this method, the slab can be efficiently reduced in its thickness without any loss of reduction force and the generation of segregation can be suppressed at the center area of the slab in the thickness direction.

A continuous casting apparatus according to the invention is suitable for carrying out the continuous casting method according to the invention.

A slab produced by the method according to the invention has good quality, since the segregation at the center area can be improved over the entire width in which the liquid core 11 is included.

1 Claim, 8 Drawing Sheets

CONTINUOUS CASTING METHOD, CONTINUOUS CASTING APPARATUS AND CONTINUOUSLY CAST STEEL SLAB

FIELD OF THE INVENTION

The present invention relates to a method and an apparatus for continuously casting a steel slab (hereinafter referred to as "slab"), which are capable of suppressing the generation of element segregation in the center part in the thickness direction of the slab. The present invention also relates to a steel slab produced by such a continuous casting method.

DESCRIPTION OF THE PRIOR ART

Traditionally, the rolling of a steel plate is carried out, in approximately the same amount of thickness reduction for both upper and lower reduction rolls, i.e., a symmetrical thickness reduction with a pair of reduction rolls. In recent years, the thickness of a slab with a liquid core is reduced, using a curved type or a vertical bending type continuous casting machine. In this case, it is necessary to pass a dummy bar through the casting machine without any trouble at the start of casting. Therefore in the reducing of the slab with a liquid core, the lower reduction roll is normally fixed to the base of the casting machine in such a way that the reducing position is set at the same level as the lower pass line for the slab, and thereby the upper roll is exclusively used to roll the slab or to reduce the thickness thereof.

In the continuous casting of a slab, there is a possible problem that inner defects, i.e., so-called center segregations are frequently generated. The center segregation is a positive segregation, within which elements, such as C, S, P, Mn and the like, are concentrated at the center part in the thickness direction of the slab as a final solidification zone. The center segregation causes not only the toughness of the steel plate to be reduced, but also the hydrogen induced cracking to be generated, so that a serious problem takes place, in particular for producing thick steel plates. In order to avoid such a serious problem, the following technologies have already been proposed.

In Japanese Patent Application Laid-open Publication No. 61-42460, a continuous casting method has been developed, in which method the center segregation may be avoided without the generation of internal cracks by employing a greater thickness reduction of not less than 3 mm, which is greater than the amount of contraction with solidification. In this method, using an electromagnetic stirrer or an ultrasonic generator disposed upstream in the vicinity of a complete solidification point or a crater end of the slab, dentrites are broken by the flow of molten steel, and then the thickness reduction is carried out after forming an area of equiaxed structure. In this method, however, no sufficient effect of thickness reduction can be obtained, because the reduction rolls and frames for holding them are bent. This problem results from the fact that the solidified parts having a large deformation resistance at edges of the slab are reduced to provide a plastic deformation, so that the reduction rolls are bent, when either steel having a large deformation resistance or a slab having a large deformation resistance at the edges thereof at a low temperature is reduced.

Japanese Patent Application Laid-open Publication No. 61-132247 discloses a continuous casting method, in which, in order to efficiently apply the reduction force to a stab, stepped rolls with a projection in the middle part of a large diameter roll, called as "camel crown roll", are used to locally reduce the thickness of the slab with an un-solidified part or a liquid core at the center in the width direction. In this method, however, the stepped rolls cause a depression to be formed on the surface of the slab due to the local reduction force, so that insufficient precision may be obtained regarding the size and the surface flatness in the subsequent rolling process.

The present inventors have already proposed a continuous casting method, as disclosed in Japanese Patent Application Laid-open Publication No. 9-57410, wherein guide rolls are sequentially arranged in the thickness direction of a slab such that the spacing between guide rolls facing each other is stepwise increased from a position just below the mold in the direction of withdrawing the slab, and wherein the slab including a liquid core is bulged beforehand, and then the thickness of the slab is reduced by an amount corresponding to the bulging thickness. In this method, however, it was found that there still remained a problem that the improvement effect in the generation of the center segregation could not be attained when the thickness reduction was insufficient at the area including a large un-solidified layer.

Furthermore, it is known that there are the following continuous casting methods, in which the generation of internal cracks is suppressed without bulging of the slab.

Japanese Patent Application Laid-open Publication No. 62-28056 discloses a continuous casting method, in which, using a curved type continuous casting machine with which a relatively greater amount of equiaxed structure may be generated on the lower side of the slab, the reduction force is set to be greater on the lower surface than on the upper surface of the slab, when the thickness of the slab including a liquid core is reduced. In this method, the reduction force may be replaced with the amount of thickness reduction. Even when either the reduction force or the amount of thickness reduction is used, the reduction is carried out without bulging to suppress the generation of internal cracks, so that the reduction in the amount of element segregation is insufficient.

Japanese Patent Application Laid-open Publication 7-132355 discloses a continuous casting method, in which a rolling mill is disposed at a predetermined position in the rear end of a continuous casting machine and the cast slab including a liquid core is rolled intentionally without bulging. In this method, a slab, in which the ratio of the width to the thickness of the slab is not less than 5 and the ratio of the thickness of the liquid core to the thickness of the slab is not more than ½, is rolled under a condition of greater than a predetermined value which is determined from the thickness of the slab and the thickness of the liquid core. However, this method is intended to prevent the internal cracks from generating at a greater thickness reduction without bulging of the slab, so that no sufficient effect on the suppression of generating the element segregation can be attained.

FIG. 1 is a schematic view of a continuous casting machine including a conventional apparatus for reducing the thickness of a slab in the longitudinal section. In FIG. 1, molten steel 4, which is supplied into a mold 3 via an immersion nozzle 1, is cooled by the water-cooled mold 3 as well as by the water sprayed from spray nozzles (not shown) disposed therebelow, and thereby a solidified shell 5 is formed. A slab including a liquid core 11 in the inside thereof is supported and guided by guide rolls 6, and further the thickness of the slab is reduced by a reduction roll pair 7 consisting of an upper reduction roll and a lower reduction roll. The slab is further withdrawn with the aid of pinch rolls 14. In FIG. 1, zone B1–B2 indicated by arrows at the ends thereof means the bulging zone where the slab is bulged by the static pressure of the molten steel. The uppermost surface of the lower reduction roll 7*b* in the reduction roll pair 7 is set at the same level as the lower pass line 9 of the slab.

FIG. 2 schematically shows the state of the thickness reduction at high magnification in the vicinity of a reduction roll pair, using the conventional thickness reduction method shown in FIG. 1, where the slab is bulged only on the lower side. FIG. 2A is a side view of an thickness reduction apparatus and FIG. 2B is a section of the slab viewed from line A—A in FIG. 2A. In FIG. 2, dashed lines L1 and L2 represent the longitudinal center lines of the slab in the thickness direction (hereinafter referred to as "longitudinal center line on the narrow side of the slab"). In this case, an area indicated by a symbol S means the area in which the thickness of the slab is increased by a magnitude of bulging, i.e., an amount corresponding to the bulging thickness.

As shown in FIG. 2, the longitudinal center line L1 on the narrow side of the slab is located at a level different from the center position of the roll cavity (the spacing between the upper reduction roll 7*a* and the lower reduction roll 7*b* at the position of thickness reduction). When, therefore, trying to reduce the thickness by an amount corresponding to the bulging thickness, the slab has to be bent by δ (a magnitude of bending), together with the thickness reduction. Accordingly, in the actual thickness reduction, the applied force for thickness reduction is substantially decreased by the force necessary for overcoming the reaction force of bending the slab. This is the reason why the reduction force used only for reducing the amount corresponding to the bulging thickness does not reach the target value for the reduction force.

FIG. 3 schematically shows the state of reducing the thickness of a slab at high magnification in the vicinity of the reduction roll pair, using the conventional method of thickness reduction shown in FIG. 1, where the slab is bulged substantially symmetrically on the upper and lower sides. FIG. 3A is a side view of the thickness reduction apparatus and FIG. 3B is a section of the slab viewed from line A—A in FIG. 3A. In FIG. 3, dashed lines L1 and L2 represent the longitudinal center lines of the slab in the thickness direction. In this case, the areas indicated by a symbol S mean the areas in which the thickness of the slab is increased by an amount of bulging, i.e., the amount corresponding to the bulging thickness.

In FIG. 3, the longitudinal center line L1 on the narrow side before the thickness reduction is also positioned at a level different from the center position of the roll cavity, and therefore the slab has to be bent by δ in the process of thickness reduction. Accordingly, the force necessary for bending provides a loss of the force necessary for reducing the thickness.

As described above, the concept of reducing the slab thickness symmetrically in the vertical direction after bulging the slab including a liquid core is not employed in the conventional thickness reduction method, so that the position at which the slab thickness is reduced is set the same level as the lower pass line for the slab, and the thickness reduction is carried out exclusively by the upper reduction roll. This results from a possible situation in which the projection of the uppermost surface of the lower reduction roll from the lower pass line for the slab hinders either a link type dummy bar from passing through the thickness reduction section at the start of casting or a slab including a liquid core from passing therethrough at the start of casting.

SUMMARY OF THE INVENTION

It is an object of the present invention to provide a continuous casting method, a continuous casting apparatus and a steel slab produced by the continuous casting method, in order to overcome the above-mentioned problems in which the slab including a liquid core is bulged and then reduced in the thickness of the slab at a position just before the complete solidification point, thereby enabling the slab having a good quality to be produced.

In the gist of the present invention, the following continuous casting methods (1) and (2), the following continuous casting apparatuses (3) to (5), and the following steel slab (6) produced by the continuous casting method are provided:

(1) A continuous casting method, in which a slab including a liquid core is bulged and then reduced in the thickness, using a reduction roll pair, wherein the uppermost surface of the lower reduction roll in the reduction roll pair is projected upwards from the lower pass line for the slab in a continuous casting apparatus.

(2) A continuous casting method according to the above continuous casting method (1), wherein the projection amount of the lower reduction roll in the reduction roll pair from the lower pass line is not more than the bulging thickness for the slab.

(3) A continuous casting apparatus, in which a slab including a liquid core is bulged and then reduced in the thickness, using a reduction roll pair, wherein the uppermost surface of the lower reduction roll in the reduction roll pair is projected upwards from the lower pass line for the slab in a continuous casting apparatus.

(4) A continuous casting apparatus according to the above continuous casting apparatus (3), wherein the projection amount of the lower reduction roll in the reduction roll pair from the lower pass line can be altered, before the start of casting and/or during the casting, and wherein the continuous casting apparatus is equipped with a control mechanism for maintaining the projection amount at a constant value, even when the load applied by the reduction roll pair is varied during the process of thickness reduction.

(5) A continuous casting apparatus according to the above continuous casting apparatus (3) or (4), wherein the reduction roll pair can be disposed in an arbitrary position in the continuous casting apparatus.

(6) A steel slab produced by the above continuous casting method (1) or (2), wherein the Mn segregation index $C/C_0$ satisfies the relation expressed by the following equation (a) over a width W which is expressed by the following equation (b):

$$0.7 \leqq C/C_0 \leqq 1.2 \quad \text{(a)}$$

and $$W = W_0 - 2 \times d \quad \text{(b)}$$

where C: the Mn content (mass %) at the center part in the thickness direction of the slab, $C_0$: the mean Mn content (mass %) in the slab, $W_0$: the width of the slab (mm), and d: the thickness of the solidified shell (the distance between an area of the slab having a solid fraction of 0.8 and the surface layer on the narrow side at the position of thickness reduction) (mm).

Referring to FIGS. 4A and 4B, the meaning of the above-mentioned equation (b) will be described.

FIGS. 4A and 4B are schematic transverse sectional views of a slab, respectively just before and just after reducing the thickness by means of a reduction roll pair. More specifically, FIG. 4A shows a sectional view of the state of the slab 12 including a liquid core 11 in which chemical compositions, such as C, S, P, Mn and others of the molten steel are concentrated just before reducing the thickness, and FIG. 4B shows a sectional view of the slab just after reducing the thickness by applying the reduction force thereto. The dashed lines L1 and L2 represent the center lines in the thickness direction of the slab.

$W_0$ in the equation (b) is the width of the slab 12 after casting, and d is the thickness of the solidified shell in the slab 12, and it implies the length of the slab from the surface on the narrow side to a position at which the slab has a solid fraction of 0.8. The value of d is substantially the same as the thickness of the solidified shell from the surface on the wide side of the slab to the liquid core, and therefore d can be replaced with the thickness of the solidified shell from the surface on the wide side of the slab to the liquid core. The solid fraction can be determined on the basis of, for instance, the nonsteady state heat transfer calculation, as described in Japanese Patent Application Laid-open Publication No. 9-57410.

From the drawing in FIG. 4A, it is clear that W in the equation (b) is determined by subtracting 2×d from $W_0$. Consequently, the term "the equation (a) is satisfied over the width W expressed by the equation (b)" in the above-mentioned steel slab (6) means that the relation expressed by the above-mentioned equation (a) is satisfied over the area including a liquid core 11 in the process of the thickness reduction, when the slab (6) is produced by the above continuous casting method (1) or (2).

The present invention defined in the above is accomplished on the basis of the following knowledge:

When reducing the thickness of a slab including a liquid core in a continuous casting machine, the reduction force applied to only the bulging section with the static pressure of the molten steel resulting from the surface of the molten steel in a mold (meniscus) makes it impossible to provide the desired amount of thickness reduction, so that it was confirmed that a sufficient reduction force could not be obtained with this method. The present inventors extensively studied the origin of this experimental fact, and found that the reduction force, which had to be used for reducing the thickness corresponding to the bulging thickness of the slab, was partially used for bending the slab, and thus, no efficient thickness reduction is carried out. In other words, an additional force is further required for bending and straightening the solidified part on the narrow side of the slab due to the thickness reduction of the bulged slab with only an upper reduction roll, so that the reduction force is insufficient when the thickness reduction is carried out by means of only the upper reduction roll. This is due to the fact that, in the conventional continuous casting machine, the uppermost surface of the lower reduction roll in the reduction roll pair is set at the same level as the lower pass line for the slab, and cannot be projected upwards from the lower pass line, as will be described below.

The present inventors intensively investigated the continuous casting including the thickness reduction process of a bulged slab, after intentionally shifting the lower reduction roll upwards from the lower pass line for the slab. It was found that the present method was capable of providing a much greater amount of thickness reduction as well as a greater amount of reduction force, compared with the conventional method, thereby enabling the thickness of the slab including a liquid core to be reduced more efficiently. The present invention is achieved on the basis of these experimental investigations.

FIG. 5 shows an embodiment of an apparatus for carrying out the continuous casting method according to the present invention in a longitudinal section. Molten steel 4 is supplied into a mold 3 via an immersion nozzle 1 and cooled by both the water-cooled mold 3 and water sprayed from spray nozzles (not shown), in a method similar to that in FIG. 1, and thus a solidified shell 5 is formed. A slab including a liquid core 11 in its inside is supported and guided by guide rolls 6. Zone B1–B2 indicated by arrows at the ends thereof in FIG. 5 indicates a bulging zone. Thereafter, the slab is reduced in its thickness, using a reduction roll pair 7 consisting of an upper reduction roll and a lower reduction roll, and further withdrawn by means of pinch rolls 14. In the present invention, the uppermost surface of the lower reduction roll 7*b* in the reduction roll pair 7 is disposed at a higher vertical level by δ1 than the lower pass line 9 of the slab.

FIG. 6 schematically shows the state of the thickness reduction at a high magnification in the vicinity of the reduction roll pair, using the thickness reduction method according to the present invention, as shown in FIG. 5, where the slab is bulged substantially symmetrically with respect to the upper and lower sides. FIG. 6A is a side view of the apparatus and FIG. 6B is a section of the slab viewed from line A—A in FIG. 6A. In FIG. 6, dashed lines L1 and L2 represent the longitudinal center lines on the narrow side of the slab, and areas indicated by a symbol S mean the areas in which the thickness of the slab is increased by bulging.

In FIG. 6A, the lower reduction roll 7*b* of the reduction roll pair 7 is projected at a higher vertical position by δ1 from the lower pass line for the slab, such that the longitudinal center line L1 on the narrow side of the slab before the thickness reduction is located at the same level as the center position of the reduction roll cavity. The longitudinal center lines L1 and L2 on the narrow side of the slab are located at the same level, so that no deformation of bending generates and no force necessary for bending the slab is required. As a result, the maximum reduction force can be transferred to the bulged slab, thereby making it possible to efficiently carry out the thickness reduction.

DESCRIPTION OF PREFERRED EMBODIMENTS

As described above, in the continuous casting method according to the present invention, a slab including a liquid core is bulged and then the thickness of the slab is reduced, using a reduction roll pair. In this case, the thickness reduction is carried out in a continuous casting machine under a condition that the uppermost surface of a lower reduction roll in the reduction pair is located at a higher level than the lower pass line for the slab.

Figure 1:
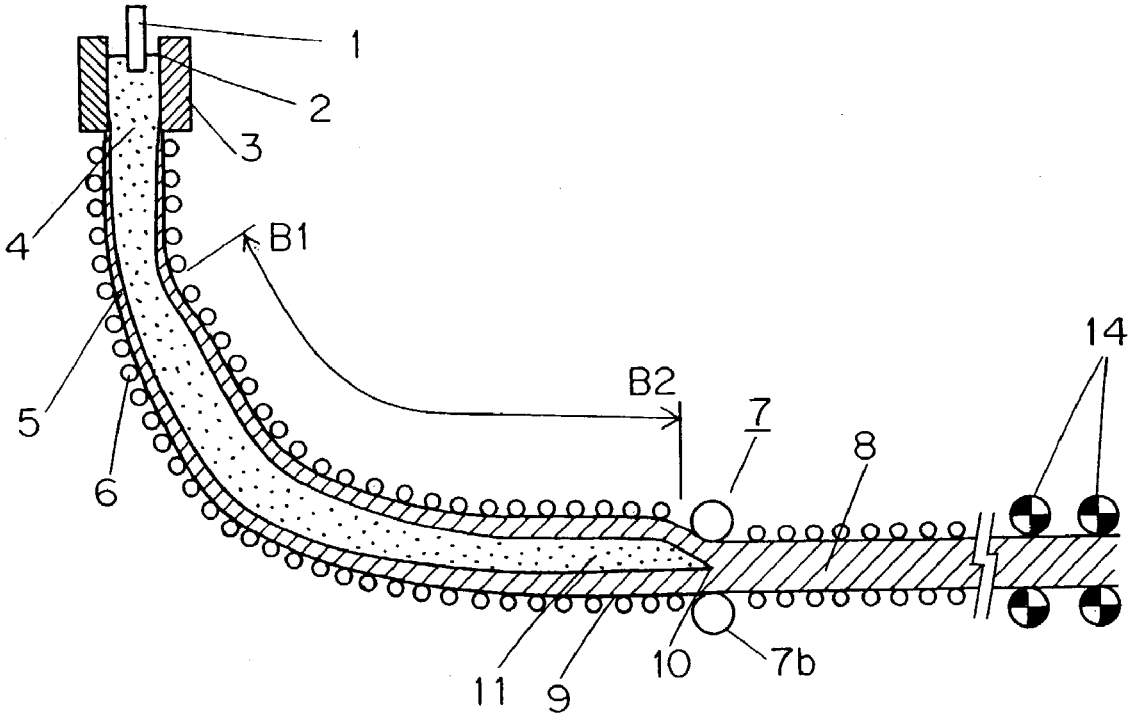
FIG. 1 Prior Art
FIG. 1 is a schematic longitudinal sectional view of a continuous casting machine for carrying out a conventional thickness reduction.
Figure 2A:
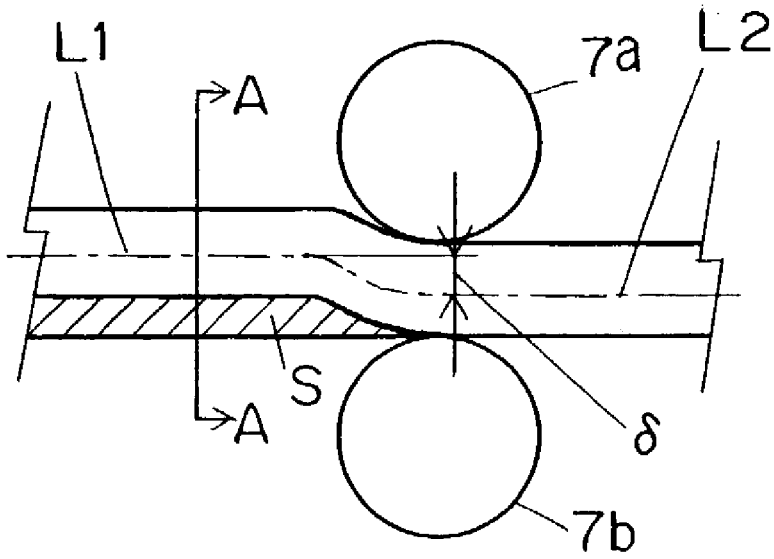
FIG. 2A Prior Art
FIG. 2A is an enlarged schematic longitudinal sectional view of a slab bulged on the lower side, when reducing the thickness of the slab by a conventional thickness reduction method in the vicinity of the thickness reducing area.
Figure 2B:
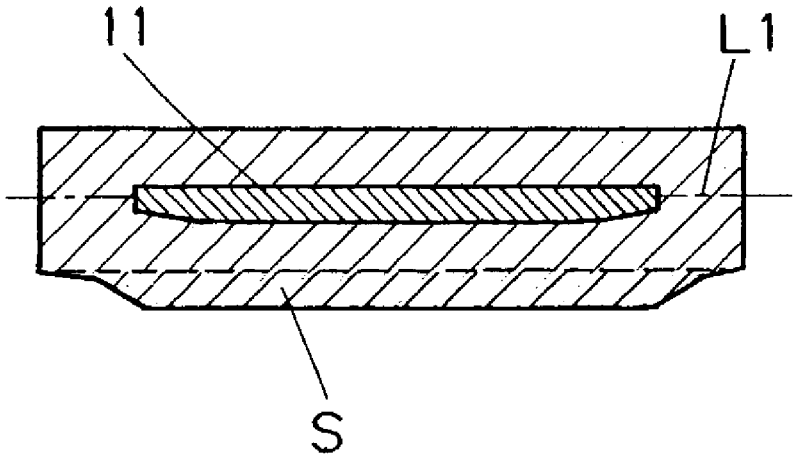
FIG. 2B Prior Art
FIG. 2B is a transverse sectional view of the slab viewed from line A—A in FIG. 2A.
Figure 3A:
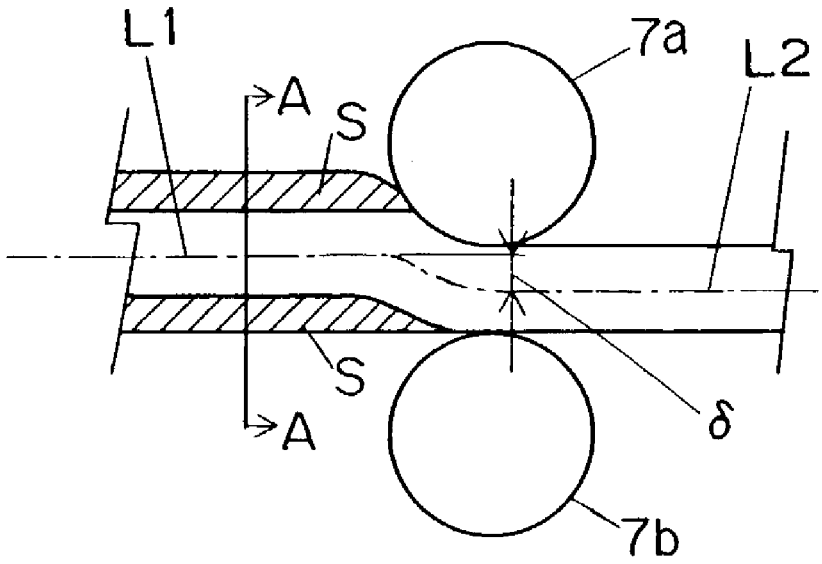
FIG 3A Prior Art
FIG. 3A is an enlarged schematic longitudinal sectional view of a slab symmetrically bulged on the upper and lower sides, when reducing the thickness of the slab by a conventional thickness reduction method in the vicinity of the thickness reducing area.
Figure 3B:
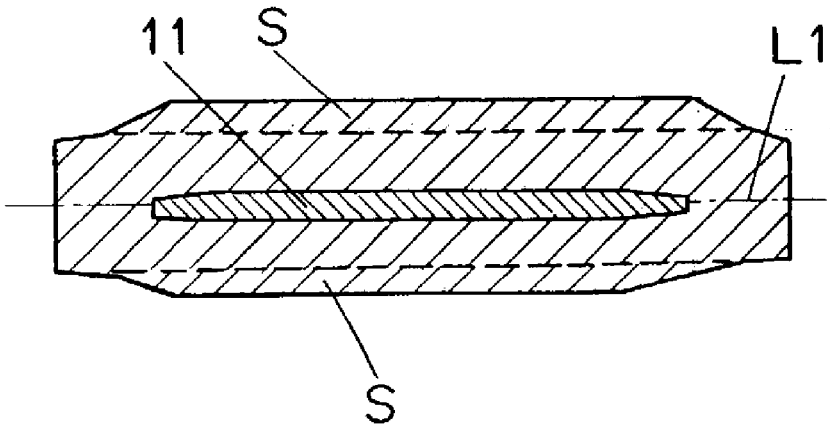
FIG. 3B Prior Art
FIG. 3B is a transverse sectional view of the slab viewed from line A—A in FIG. 3A.
Figure 4A:
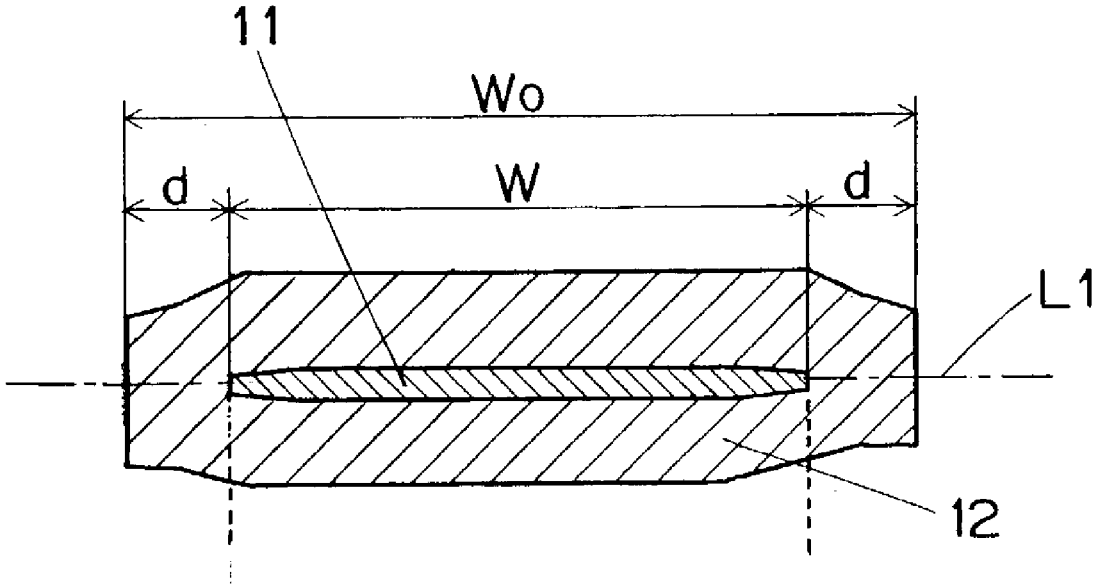
FIG. 4A is a transverse sectional view of a slab for explaining the just before the thickness reduction, using a pair of reduction rolls.
Figure 4B:
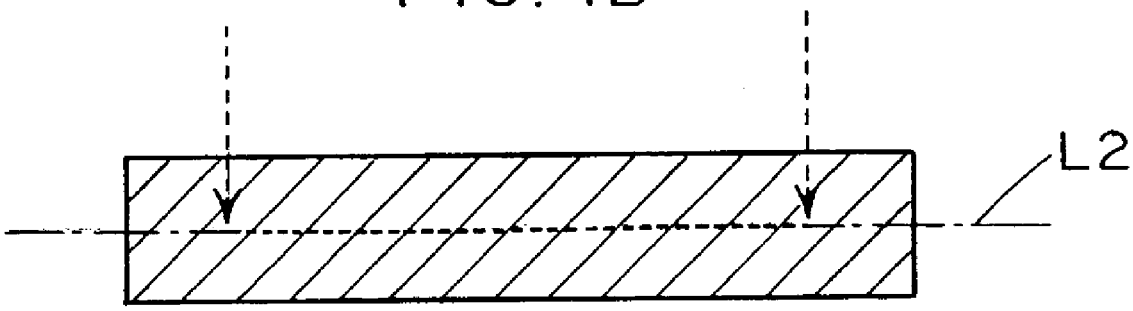
FIG. 4B is a transverse sectional view of a slab for explaining the just after thickness reduction, using a pair of reduction rolls.
Figure 5:
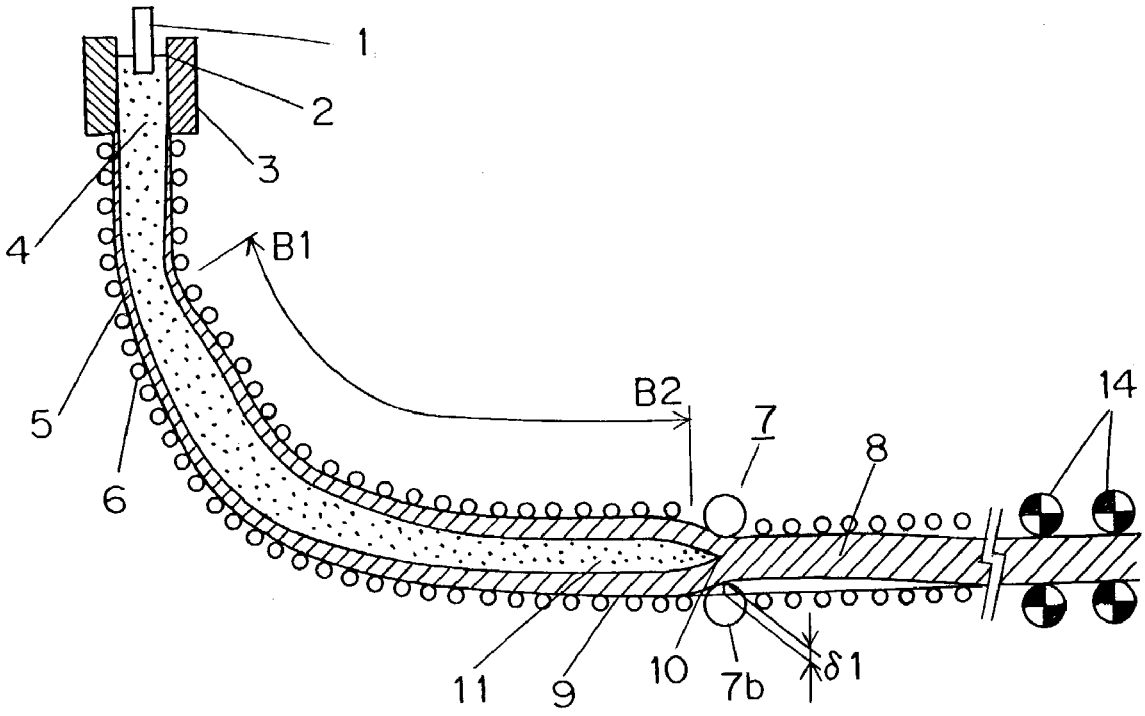
FIG. 5 is a schematic longitudinal sectional view of a continuous casting machine for carrying out a thickness reduction method according to the present invention.
Figure 6A:
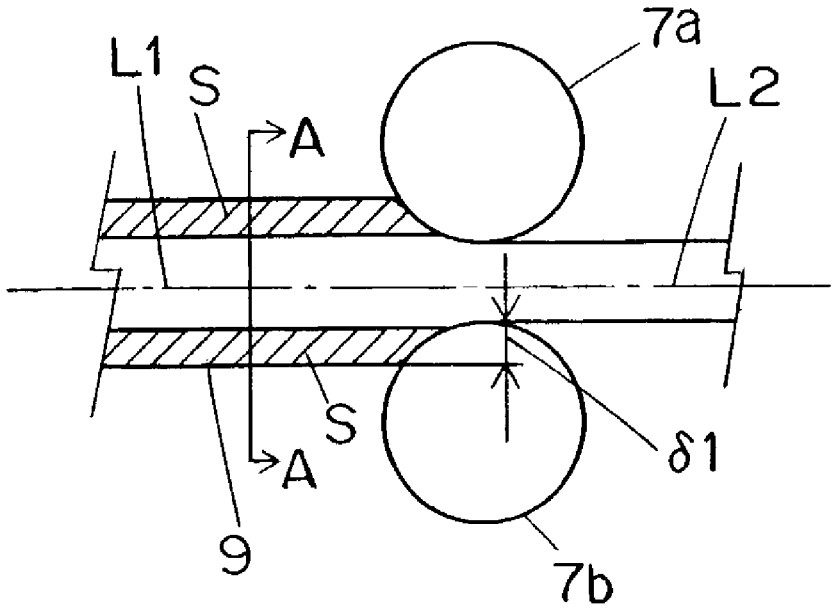
FIG. 6A is an enlarged schematic longitudinal sectional view of a slab bulged symmetrically on the upper and lower sides, when reducing the thickness of the slab by a thickness reduction method according to the present invention in the vicinity of the thickness reducing area.
Figure 6B:
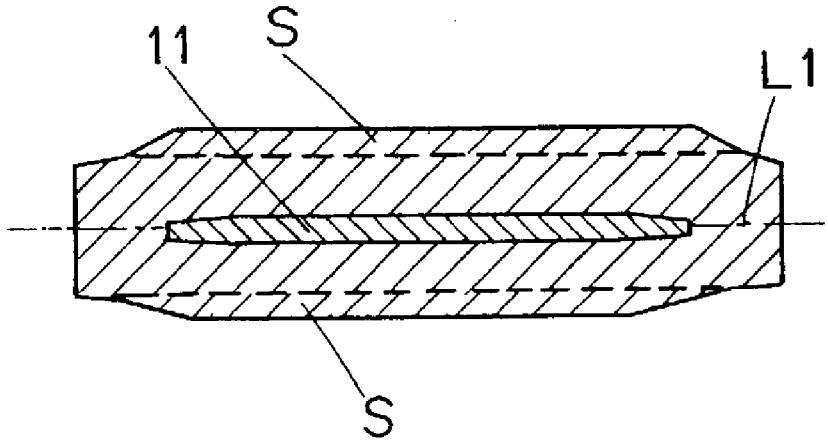
FIG. 6B is a transverse sectional view of the slab viewed from line A—A in FIG. 6A.

In this method, the slab including a liquid core is bulged and then the thickness of the slab is reduced by means of the reduction roll pair. The thickness reduction can be carried out in the vicinity of the complete solidification point 10 and preferably just before the point, as shown in FIG. 1 and FIG. 5. The amount of thickness reduction should be preferably a value corresponding to the amount of bulging. However, the amount of thickness reduction may be greater than the value of bulging.

Moreover, the thickness reduction is normally carried out in the inside of the continuous casting machine. However, the thickness reduction can be also carried out in an end of the continuous casting machine.

In the thickness reduction, the uppermost surface of the lower reduction roll is located at a higher level than the lower pass line, i.e., the pass line fixed to the base of the machine, so that the thickness can be efficiently reduced by applying the reduction force to the slab with a sufficiently reduced deformation of bending, as described above.

Since an improved effect may be appreciated even with a small amount δ1 of projection in the lower reduction roll, there is no special limitation on the range for the amount of projection, unless trouble or failure is encountered in the operation of passing the slab. If, however, it is assumed that the slab is bulged on its lower side only, the amount of projection should be preferably not more than the thickness of bulging, i.e., the total value of bulging in the slab. More preferably, the casting is carried out in such a manner that the slab is bulged approximately in the same amount on the upper and lower sides, and in this case, the amount δ1 of projection in the lower reduction roll should be set about half of the total amount of bulging. As a result, the longitudinal center line on the narrow side of the slab before the position of thickness reduction may be set at the same level as the center position in the cavity between the paired reduction rolls in the process of the thickness reduction, thereby enabling the thickness of the slab to be reduced in high efficiency principally without any deformation of bending.

In the continuous casting method according to the invention, parallel rolls can be employed for the reduction rolls, and therefore a reduction force may be effectively applied to the slab over the entire width thereof.

In conjunction with the above, if the amount δ1 of projection in the lower reduction roll is fixed in a predetermined value, there is a possible inconvenience in the operation of continuous casting. Accordingly, it is preferable that the lower reduction roll can be lifted in the vertical direction with the aid of a hydraulic elevation mechanism in accordance with the requirements in the actual operation of casting. This ensures a marked flexibility of operation in performing the method according to the invention.

In accordance with another aspect of the continuous casting apparatus according to the present invention, as described above, the slab including a liquid core is bulged and then the thickness thereof is reduced, using a reduction roll pair. In this continuous casting apparatus, the uppermost surface of the lower reduction roll is projected upwards from the lower pass line for the slab.

In the continuous casting apparatus, moreover, it is possible to vary the projection amount in the lower reduction roll of the paired reduction rolls before starting the casting and/or during the casting operation, and a control mechanism may be installed for maintaining the amount of projection in a predetermined value even if the variation in the load applied by the paired reduction rolls takes place. In addition, it is also preferable that the position of the paired reduction rolls can be altered at an arbitrary reduction position in the direction of withdrawing the slab in the continuous casting machine.

Figure 7A:
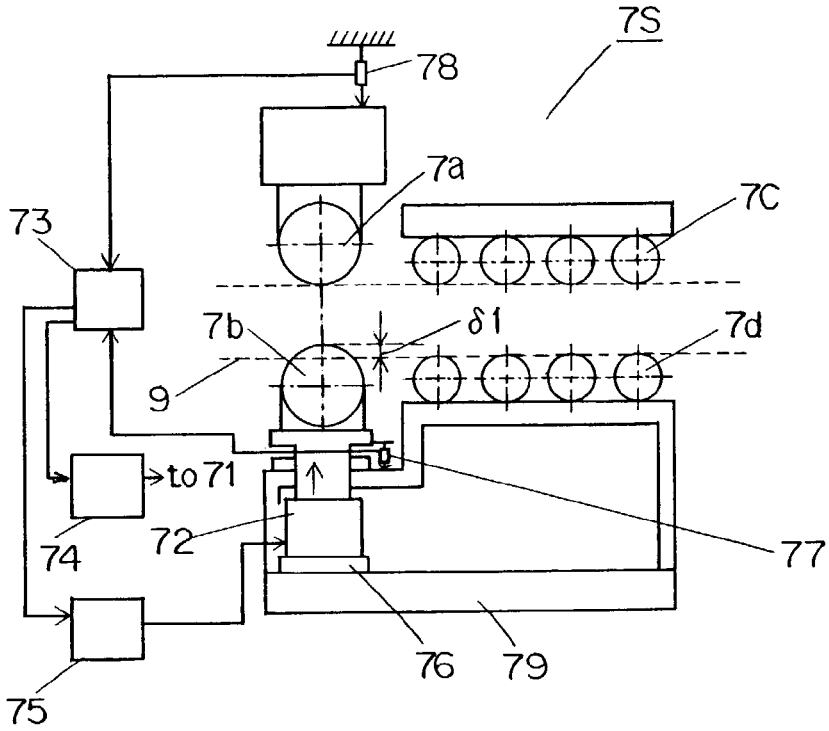
FIG. 7A is a side view of an apparatus for elevating reduction rolls.
Figure 7B:
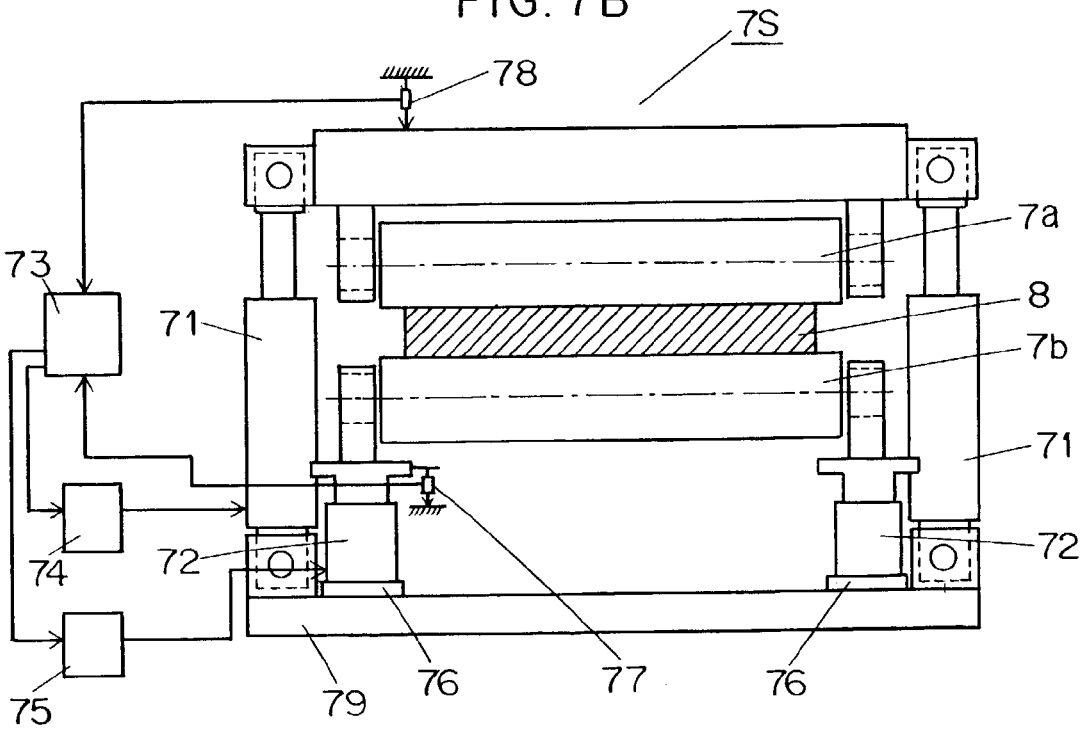
FIG. 7B is a front view of the apparatus for elevating reduction rolls.

FIGS. 7A and 7B show embodiments of an apparatus for elevating reduction rolls, wherein the side view of the apparatus is shown in FIG. 7A and the front view thereof is shown in FIG. 7B. In FIG. 7A, some components used in the apparatus for elevating the upper reduction roll as well as the slab are omitted.

A reduction roll pair system substantially comprises an upper reduction roll 7*a*, a lower reduction roll 7*b*, an upper roll elevation system 71 for moving the upper reduction roll 7*a* in the vertical direction and a lower roll elevation system 72 for moving the lower reduction roll 7*b* in the vertical direction. Each of these roll elevation systems can be equipped with, for instance, a hydraulic actuating device or an electric actuating device.

A load cell 76 for measuring the load in the reduction process is interposed between the lower roll elevation system 72 and a reduction roll segment base 79. The levels of the upper reduction roll 7*a* and the lower reduction roll 7*b* in the vertical direction are measured by an upper roll position detector 78 and a lower roll position detector 77, respectively. The measured values for the roll position are supplied to a reduction roll position control device 73.

Moreover, support rolls 7*c* and 7*d* are provided for supporting the slab 8 after the thickness reduction, and the above-mentioned components and systems are further integrated in a reduction roll pair segment 7S.

In the following, the function of the elevation systems for reduction rolls will be described.

The roll position control device 73 determines the projection amount δ1, by which the uppermost surface of the lower reduction roll 7*b* is projected from the lower pass line 9 for the slab, in accordance with the type of steel, the size of slab and others, taking the rigidity of the elevation systems for reduction rolls into account. As described for the thickness reduction method by the apparatus shown in FIG. 5, the thickness of the slab with liquid core is reduced with both the upper reduction roll 7*a* and the lower reduction roll 7*b*, and then guided and supported by the support rolls 7*c* and 7*d*. Thereafter, the slab is withdrawn as a final slab 8.

In the course of the casting process, the load applied between the upper reduction roll 7*a* and the lower reduction roll 7*b* is varied in accordance with the type of steel and the variation in the status of solidification, so that the amount δ1 of projection for the lower reduction roll and the spacing between the upper reduction roll 7*a* and the lower reduction roll 7*b*, i.e., the roll cavity are changed. The amounts of such change are detected by the reduction roll position detectors 77 and 78, and then supplied to the reduction roll position control device 73. In the reduction roll position control device 73, the amount δ1 of projection in the lower reduction roll and the deviation of the spacing between the reduction rolls from the aimed value for the roll cavity are determined, and further values to be corrected with regard to the projection amount δ1 and the roll cavity for the reduction rolls are calculated. In accordance with the calculated results, the reduction roll position control device 73 controls a hydraulic activation device 75 for the elevation of the lower reduction roll and a hydraulic activation device 74 for the elevation of the upper reduction roll to operate the lower reduction roll elevation device 72 and the upper reduction roll elevation device 71.

The above-described control may be carried out in the case of setting the amount δ1 of projection for the lower reduction roll before the start of casting. Such control of the projection amount δ1 can also be carried out during the process of casting.

Figure 8:
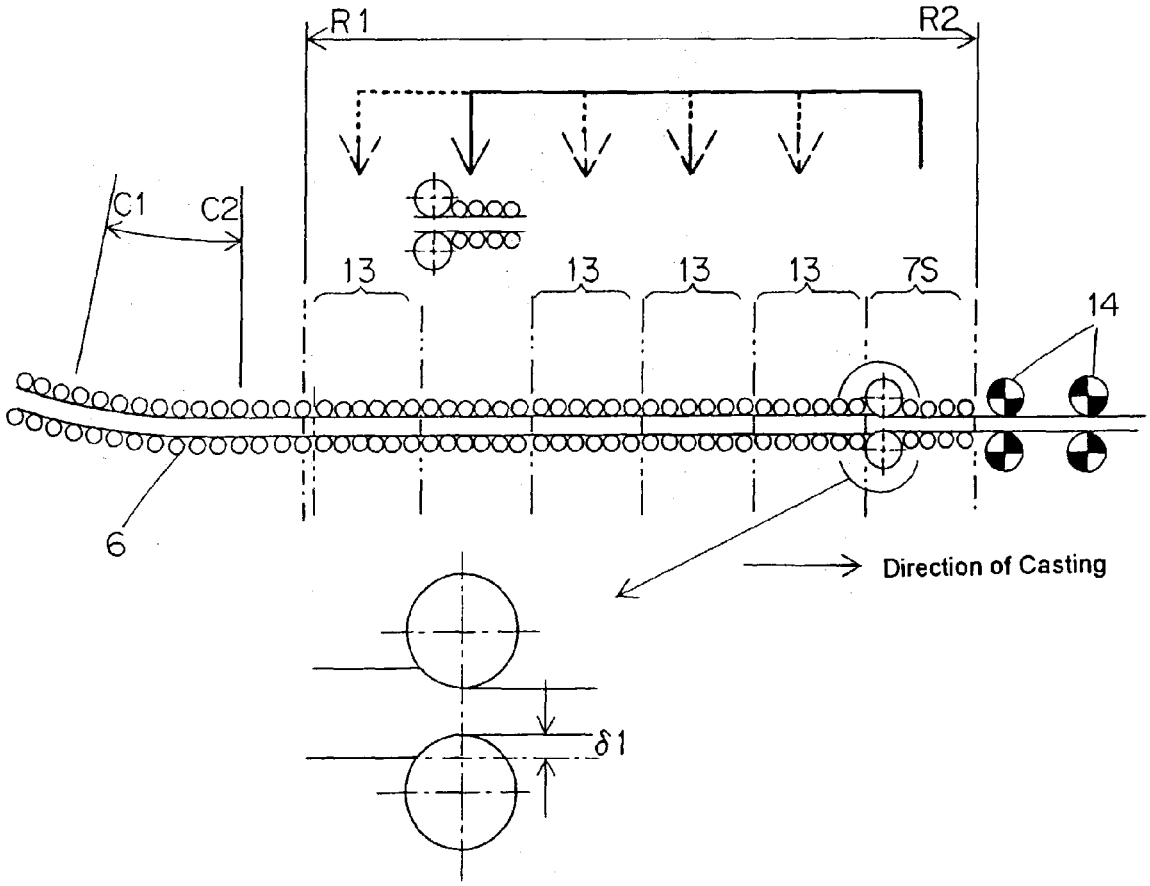
FIG. 8 is an embodiment of a mechanism for varying the arrangement position of paired reduction rolls.

FIG. 8 is a longitudinal sectional view of a mechanism for varying the arrangement position of the reduction rolls.

In the downstream of a unbending zone C1–C2 for straightening the curvature of the slab, an interchangeable segment zone R1–R2 is disposed for varying the position of the reduction roll segment 7S. Furthermore, paired pinch rolls 14 are disposed in the downstream of the common segment zone. The slab with liquid core passes through the unbending zone C1–C2, and further moves into the interchangeable segment zone R1–R2, wherein the thickness of the slab is reduced into a predetermined value. Eventually, the slab is withdrawn by the pinch rolls 14.

In the interchangeable segment zone, the reduction roll pair segment 7S and guide roll pair segments 13 are disposed. In this case, the reduction roll pair segment 7S and one of the guide roll pair segments 13 can be replaced with each other to change the position of thickness reduction. In FIG. 8, the reduction roll pair segment 7S is disposed in the end of the interchangeable segment zone. However, for example, the reduction roll pair 7S can be disposed upstream, as indicated by a solid line arrow, and the guide roll pair segment 13 disposed therein can be replaced with the reduction roll pair 7S which is initially disposed at the end of the interchangeable segment zone.

Similarly, the reduction roll pair segment 7S can be disposed at a position indicated by anyone of dotted line arrows. Accordingly, the reduction roll pair can be disposed at an arbitrary position in the withdraw direction of the slab. If, moreover, a supplementary reduction roll pair segment is provided, the preparation time necessary for altering the arrangement position of the reduction roll pair segment can be shortened and therefore the rate of operation for the continuous casting apparatus can be enhanced.

In the continuous casting apparatus according to the present invention, an electromagnetic stirrer can be disposed upstream with respect to the reduction roll pair, although such an arrangement is not always indispensable for the apparatus according to the present invention. Such a stirrer provides the fluidity for the liquid core in the slab and therefore enables the segregation to be effectively dispersed therein.

In another aspect of the present invention, a slab produced by the continuous casting method according to the invention has a Mn segregation index $C/C_0$ expressed by the following equation (a) over a width W expressed by the following equation (b):

$$0.7 \leqq C/C_0 \leqq 1.2 \quad \text{(a)}$$

and $$W = W_0 - 2 \times d \quad \text{(b)}$$

where C is the Mn content (mass %) at the center area in the thickness direction, $C_0$ is the mean Mn content (mass %) in the slab, $W_0$ is the width of the slab (mm), and d is the thickness of the solidified shell (which corresponds to the distance between an area of the slab with a solid fraction of 0.8 and the surface layer on the narrow side at the position of reduction roll pair, and it is expressed in the unit of mm).

The reason why the lower and upper limits are set 0.7 and 1.2, respectively, are as follows:

A $C/C_0$ value of less than 0.7 provides no sufficient mechanical property of the steel material, whereas a $C/C_0$ value of more than 1.2 provides a much greater local mechanical strength, thus tending to generate the unevenness in the material. Actually, the segregation at the center area causes the toughness of the steel products to be reduced and the hydrogen induced cracking to be generated at a high frequency. There is a very severe problem, in particular for producing thick plate products.

As described above, the equation (b) expresses the range of the steel area within which the liquid core includes an concentrated chemical compositions, such as C, S, P, Mn and others of the molten steel in the position of thickness reduction, the content being expressed by the equation (a). In other words, the concentration of the elements dissolved in the area of the liquid core is reduced or improved.

EXAMPLES

Using a vertical bending type continuous casting machine having a structural arrangement shown in FIGS. 5, 7A, 7B and 8, which machine is capable of producing a slab having a 235 mm thickness and a width of 1,800–2,300 mm, various tests were carried out, as for slabs for thick steel plate made of a low carbon steel at a carbon concentration of 0.06–0.07 mass %, the thickness reduction of the slabs was reduced with a pair of reduction rolls having the maximum reduction force of $4.90 \times 10^6$ N, after bulging. The test procedures were the same as those described in FIGS. 5, 7A, 7B, and 8.

In the test, each of the slabs was produced by the casting machine, after setting the amount of projection for the lower reduction roll to be 0, 1, 10, 12 or 15 mm, and the Mn segregation index $C/C_0$ was determined for each of the slabs thus produced to evaluate the state of Mn segregation at the center area.

The conditions and the results obtained in the test are summarized in Table 1.

TABLE 1

| | Test No. | Casting Speed (m/min) | Amount of Bulging (1) (mm) | Projection of Lower Reduction Roll (2) (mm) | Preset Amount of Thickness Reduction for Upper Reduction Roll (1)–(2) (mm) | Actual Amount of Thickness Reduction (mm) | Maximum Value of Mn Segregation Index $C/CO_0$ (—) | Remarks |
|---|---|---|---|---|---|---|---|---|
| Comparative Examples | 1 | 0.98 | 23.7 | 0 | 23.7 | 19.9 | 1.3–1.6 | |
| | 2 | 0.98 | 23.7 | 0 | 23.7 | 18.6 | | |
| | 3 | 0.98 | 23.7 | 0 | 23.7 | 18.5 | | |
| | 4 | 1.01 | 23.7 | 0 | 23.7 | 22.5 | | |
| | 5 | 1.01 | 23.7 | 0 | 23.7 | 23.1 | | |
| | 6 | 1.01 | 23.7 | 0 | 23.7 | 23.1 | | |
| Inventive Examples | 7 | 1.25 | 25.0 | 1 | 24.0 | 19.3 | 1.1–1.2 | 1.5 at Edge Side of Slab, Solidification Partially Delayed |
| | 8 | 1.25 | 25.0 | 1 | 24.0 | 19.7 | | |
| | 9 | 1.20 | 25.0 | 10 | 15.0 | 24.8 | 1.0–1.1 | |
| | 10 | 1.20 | 25.0 | 10 | 15.0 | 25.3 | | |
| | 11 | 1.20 | 25.0 | 12 | 13.0 | 25.4 | | |
| | 12 | 1.20 | 25.0 | 12 | 13.0 | 25.2 | | |
| | 13 | 1.20 | 25.0 | 12 | 13.0 | 25.2 | | |
| | 14 | 1.22 | 25.0 | 12 | 13.0 | 25.9 | | |
| | 15 | 1.18 | 30.0 | 15 | 15.0 | 32.5 | | Small Internal Cracks Observed |
| | 16 | 1.18 | 30.0 | 15 | 15.0 | 32.0 | | |

In Table 1, "the preset amount of thickness reduction for the upper reduction roll" is determined as a desired amount of thickness reduction for the upper reduction roll ((1)–(2) in Table 1) by subtracting the projection amount of the lower reduction roll ((2) in Table 1) from the amount of bulging ((1) in Table 1). The "actual amount of thickness reduction" is determined as an actual amount of thickness reduction by subtracting an actual roll cavity in the reduction from the thickness of the bulged slab.

In this case, the maximum load was set to be $4.90\times10^6$ N. Using a load cell disposed beneath the lower reduction roll elevation apparatus, it was confirmed that a load of $1.67\times10^6$ N–$4.90\times10^6$ N was actually applied to the lower reduction roll in accordance with the reduction condition. Moreover, it was further ascertained that the load measured with the load cell under the condition of thickness reduction increased with the increase of the projection amount of the lower reduction roll.

Hence, it was found that an increase in the projection amount of the lower reduction roll provided an increased contribution of the lower reduction roll to the thickness reduction of the slab. This is due to the fact that the reduction force used for consuming the bending deformation of the slab in the entire reduction force providing by the upper reduction roll is reduced and therefore the maximum reduction force is exclusively used for reducing the thickness of the slab.

Moreover, "the maximum value of Mn segregation index $C/C_0$" was determined in the following procedure: The cast slab was first micro-etched and the etched surface was observed. Thereafter, a test piece was prepared by arbitrarily collecting from the slab including the Mn-concentrated center area in the direction of thickness. By utilizing an electron probe X-ray micro analyzer having the element mapping function, four different image fields each having a $20\times20$ mm$^2$ area of the test piece surface were observed with a probe diameter of 50 μm to evaluate both the mean Mn concentration ($C_0$) in the slab and the Mn concentration (C) in the enrich area in the vicinity of the center, so that the Mn segregation index $C/C_0$ was obtained therefrom. In Table 1, the maximum value of the Mn segregation index is represented as a typical value.

As shown in the column of "the maximum value of Mn segregation index $C/C_0$" of Table 1, the value of $C/C_0$ is greater than 1.2, i.e., the upper limit specified by the invention for all of the test Nos. 1–6 in the comparative example, where the lower reduction roll is not projected, i.e., the projection amount of the lower reduction roll is 0 mm.

On the contrary, in the test Nos. 7–16 of the inventive examples where the uppermost surface of the lower reduction roll is projected upwards from the lower pass line, the value of $C/C_0$ ranges from 1.0 to 1.2, except for a part of the test Nos. 7 and 8, so that a marked improvement of the segregation in the center area can be discerned. From these results, it can be stated that, in order to improve the segregation in the center area, it is particularly important to locate the uppermost surface of the lower reduction roll at a higher level than the lower pass line.

In the test Nos. 7 and 8, a discernible improvement can be found even when the uppermost surface of the lower reduction roll is projected upwards from the lower pass line by 1 mm. In this case, however, there is a possibility that the value of $C/C_0$ increases in the solidification delay areas at the edge side of the slab. Accordingly, it is preferable that the amount of projection for the lower reduction roll should be 50%±10% of the total bulging amount.

In the test Nos. 15 and 16 of the inventive examples where the amount of bulging is 30 mm and the amount of projection for the lower reduction roll was 15 mm, the value of $C/C_0$ was the same as that in the test Nos. 9–14, i.e., 1.0–1.1, but small internal cracks were observed. From these results, it is preferable that the amount of bulging should be not more than 25 mm.

As described in detail, the continuous casting method according to the present invention provides high efficient thickness reduction without substantial loss of the reduction force for the slab with a liquid core after bulging, thereby enabling the segregation to be reduced at the center area of the slab in the thickness direction. Moreover, the continuous casting apparatus according to the present invention allows stably controlling the amount of projection for the lower reduction roll from the lower pass line as well as arbitrarily varying the position of the reduction roll pair and therefore is particularly suitable for achieving the continuous casting method according to the present invention. In conjunction with the above, the steel slab produced by the method according to the present invention provides good quality since the center segregation is improved over the entire area of the slab including a liquid core in the width direction.

What is claimed is:

1. A continuous casting method, comprising the following steps of:

guiding molten steel from an immersion nozzle into a mold;

guiding a slab formed in said mold to a plurality of guide roll pairs;

bulging said slab by providing an increased spacing between a select number of the guide roll pairs to produce a bulged slab with a liquid core;

completing the solidification of a liquid core in a thickness-wise center part of said bulged slab at the position where the bulged slab is reduced, and reducing the thickness of said bulged slab to a predetermined thickness with a reduction roll pair comprising an upper reduction roll and a lower reduction roll, wherein the uppermost surface of said lower reduction roll is projected a distance higher than a lower pass line for the slab, wherein the projection distance of the uppermost surface of the lower reduction roll from the lower pass line for the slab is based on a bulging thickness of the slab and the projection distance is the same as or not more than a bulging thickness of the bulged slab, wherein by reducing the bulged slab, a Mn segregation index $C/C_0$ in the thickness-wise center part satisfies the relation expressed by the following equation (a) over the width W which is expressed by the following equation (b):

$$0.7 \leqq C/C_0 \leqq 1.2 \quad \text{(a), and}$$

$$W = W_0 - 2 \times d \quad \text{(b)}$$

where C: the Mn content (mass %) at the center part in the thickness direction of the slab, $C_0$: the mean Mn content (mass %) in the slab, $W_0$: the width of the slab (mm), and d: the thickness of the solidified shell (the distance between an area of the slab with a solid fraction of 0.8 and a surface layer on a narrow side at the position of thickness reduction) (mm).

* * * * *